United States Patent [19]

Saito et al.

[11] 3,934,699

[45] Jan. 27, 1976

[54] HANDRAIL SAFETY DEVICE

[75] Inventors: Chuichi Saito, Katsuta; Schoichi Nakao, Mito, both of Japan

[73] Assignee: Hitachi, Ltd., Japan

[22] Filed: Mar. 1, 1974

[21] Appl. No.: 447,353

[30] Foreign Application Priority Data

Mar. 2, 1973 Japan ..... 48-24323

[52] U.S. Cl. ..... 198/16

[51] Int. Cl.[2] ..... B66B 9/12

[58] Field of Search ..... 198/16 MS, 16 R, 232; 200/47, 61.41

[56] References Cited

UNITED STATES PATENTS

| | | | |
|---|---|---|---|
| 2,846,045 | 8/1958 | Fowler | 198/16 R |
| 2,848,093 | 8/1958 | Van Etten | 198/16 R |
| 3,670,862 | 6/1972 | Kito | 198/16 R |
| 3,809,206 | 5/1974 | Bredehorn et al. | 198/16 R |

FOREIGN PATENTS OR APPLICATIONS

| | | | |
|---|---|---|---|
| 1,169,629 | 5/1964 | Germany | 198/16 R |

*Primary Examiner*—Evon C. Blunk
*Assistant Examiner*—Richard K. Thomson
*Attorney, Agent, or Firm*—Craig & Antonelli

[57] ABSTRACT

A moving stairway having inlet housings provided externally of skirt guards, adjacent to entrance and exit portions thereof, through which handrails run in or run out. This handrail safety device comprises each of said inlet housings being provided externally of each skirt guard entrance and exit portions through which the handrails run in or run out; and a detecting switch provided in each inlet housing, said detecting switch being actuated in response to an external force acting on the inlet housing in a horizontal or vertical direction thereof, thereby interrupting movement of the moving stairway.

14 Claims, 7 Drawing Figures

HANDRAIL SAFETY DEVICE

This invention relates to a handrail safety device for use in a moving stairway, and more particularly to a safety device provided in entrance and exit portions, through which handrails run in or run out, in a position adjacent to upper and lower landing or treading plates of the moving stairway.

The moving stairway in general is equipped with a pair of handrails unidirectionally travelling at the same speed as that of the moving stairway. The handrails run into a machine section in the turnback portions adjacent to the landing places.

Recently, in an attempt to improve the appearance of a moving stairway, there have been used a lot of moving stairways, having considerable length, being covered from projecting bent portions at the upper most and lower most ends of the handrail to the coverings provided for entrance and exit portions, through which handrails run in or run out. Such a moving stairway has been proposed by U.S. Pat. No. 3,321,059 and is now in wide use.

Such a construction is attractive in the aspect of the improvements in design, while it necessarily results in a considerably large opening between a lower run of handrail and the floor surface, thereby presenting a risk that a part of body or the like is liable to be caught in the aforesaid opening. In detail, in the event that a luggage or the like accidentally touches a lower run of moving handrail, the frictional force acts to draw the luggage into the aforesaid opening. Especially, if a human body inadvertently comes to contact the moving handrail, he will be injured due to pressure or friction present between the lower run of the moving handrail and the floor. In the case of a piece of luggage, damage results on the side of the luggage or otherwise the side of the handrail is damaged.

A moving stairway in general is equipped with inlet housings near entrance and exit portions through which handrails run into or out of a machine section, the inlet housing being generally made of a comparatively hard synthetic rubber or the like. Meanwhile, as stated in U.S. Pat. No. 2,846,045, accidents frequently happen where an infant is caught in the inlet housing by the moving handrails, especially at the entrance and exit portions where the handrails run in or run out. This is because the instinctive curiosity of an infant requiring him to touch the moving handrail with his fingers.

A number of means for preventing such accidents for infants, have been hitherto proposed, for example by U.S. Pat. Nos. 2,846,045, 2,848,093 or the like. Those patents, however, still suffer from the problem that a safety device very often fails to operate, because of the small size of the inlet housing, when an infant has caught in the inlet housing opening or in the aforesaid opening between the lower run of handrail and the floor.

It is an object of the present invention to provide a handrail safety device for use in a moving stairway, wherein in the event that something gets into an opening defined between the lower run of the handrail and the floor, or in the event that an infant has his fingers caught in the inlet housing openings, the handrail safety device is immediately actuated to interrupt the movement of the moving stairway.

Another object of the present invention is to provide a handrail safety device, which is simple in construction and which ensures an interruption of the movement of a moving stairway, as required.

A further object of the present invention is to provide a handrail safety device which is easy in maintenance.

A still further object of the present invention is to provide a handrail safety device which is free from malfunctions.

To attain the objects described, a handrail safety device is provided for use in a moving stairway having inlet housings provided externally of skirt guards adjacent to entrance and exit portions, through which the handrails run into or run out, characterized in that said inlet housings are arranged in a manner to project outwardly or externally from the skirt guards at the entrance and exit portions into which the handrails run in or run out of a machine section, and a detecting switch is provided in each inlet housing, said detecting switch being actuated in response to an external force which would be applied to the inlet housing in a horizontal or vertical direction thereof.

These and other objects and features will be understood from the description of preferred embodiments made in conjunction with accompanying drawings.

DETAILED DESCRIPTION OF THE INVENTION

Figure 1:
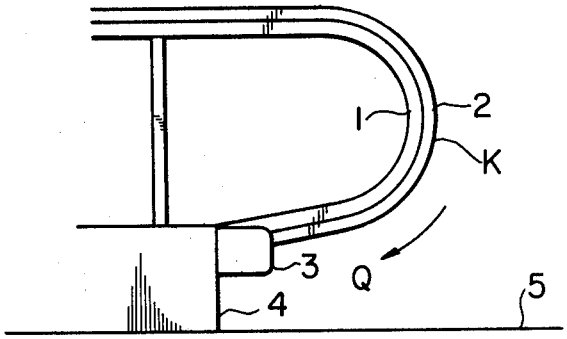
FIG. 1 is a side view of an exit portion, through which a handrail runs into or out of a machine room, and which is provided with a safety device of the present invention.
Figure 2:
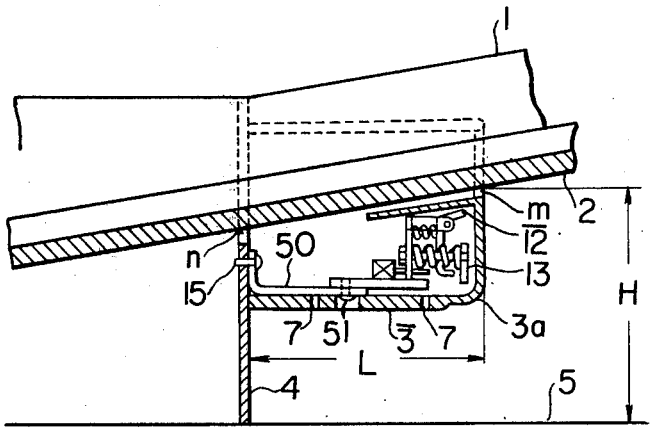
FIG. 2 is an enlarged view illustrating the interior of the handrail exit portion.
Figure 3:
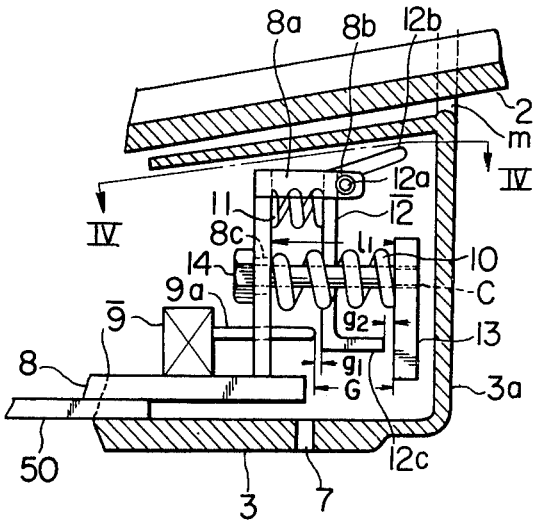
FIG. 3 is an enlarged view of an essential part of the handrail exit portion of FIG. 2.
Figure 4:
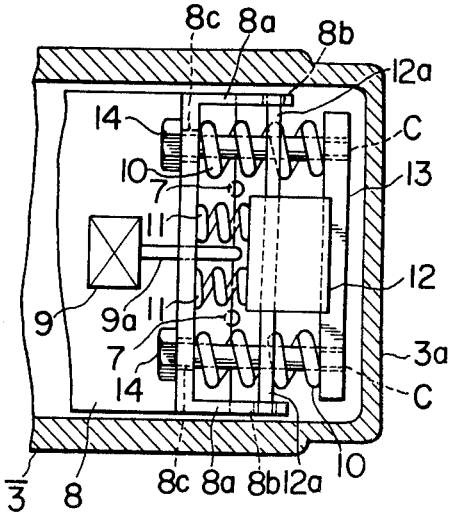
FIG. 4 is a cross-sectional view taken along the line IV—IV of FIG. 3.

A moving handrail 2 entrained around a handrail frame 1 travels at the same speed as that of the moving steps (not shown), past a turn-back portion in a projecting bent end portion, to merge via an inlet 3 into a skirt guard 4. From the viewpoint of the improvements in design, the handrail frame 1 is so arranged as to project externally of the skirt guard 4 to a considerable extent. This defines an opening Q between a lower run of the handrail 2 and the floor 5. The inlet housing 3 is made of comparatively soft rubber, or the like, and with a comparatively elongated shape as best seen in FIG. 2. The inlet housing 3 involves therein a supporting member 50 rigidly mounted by a rivet 15 on the skirt guard 4; a supporting lever or member 8 removably fastened by a rivet 51 to the supporting member 50; a detecting switch 9 attached to the supporting member 8; pairs of springs 10, 10 and 11, 11; a lever 12; an actuating plate 13; and a pair of bolts 14, 14. The inlet housing 3 has a front wall 3A reduced in thickness so as to be readily yieldable. The inlet housing 3 is provided with a hole 7 in its bottom wall, through which drains water introduced in the inlet housing 3. A supporting rod 12A is formed integrally with the lever 12, and pierces through-holes **8*b* provided in arms 8A, 8A of supporting member 8, but is free to rotate. A pair of arms 8A, 8A of the supporting member 8 are provided in mirror-image relation to each other with the lever 12 being interposed therebetween. A pair of bolts 14, each of which pierces through spring 10 for the retention thereof, are arranged in parallel relation. Each bolt 14 extends through a hole 8c provided in the supporting member 8, with its one end fixedly attached to the actuating plate 13 at the point C, so that a length $l_1$ of each spring 10 may be maintained constant. The lever 12 is a substantially inverted U-shape member having an arm 13B and an arm 12C. The lever 12 is normally urged towards the actuating plate 13, from behind, with a constant force given by a pair of springs 11 which are arranged in parallel relation, in a manner that a gap $g_2$ is left between the front face of actuating plate 13 and the lever 12, and a gap $g_1$ is left between the actuating rod 9***a* of detecting switch 9 and the lever 12. The lever 12 is free to rotate about the supporting rod 12A serving as a fulcrum. The actuating plate 13 is rigidly mounted on respective bolts 14 through springs 10 and extends widthwise in the inlet housing 3 at a distance G from the detecting switch 9, with the lever 12 being interposed therebetween. The detecting switch 9 is provided so as to bring its actuating rod 9A in alignment with a mid portion of the lever 12 and constitutes part of a control circuit (not shown) for the moving stairway, such that when the actuating rod 9A is subjected to compression or deflection, the movement of the moving stairway, and hence the handrails, may be stopped. The inlet housing 3 is reduced in thickness for the front wall portion 3A adjacent to the actuating plate 13, so as to decrease the rigidity inherent in the material of the inlet housing, as set forth in the foregoing. Thus, the actuating plate 13 may be operated in response to any external force which would be applied to the inlet housing 3, so as to actuate the handrail safety device, whenever the external force is exerted thereon. As an alternative, a flexible sheet of sponge may be separately attached to the front wall portion 3A. If an extremely soft material is used as the material for the inlet housing 3, there is no necessity to reduce the thickness in that portion or to attach another material thereto. In this embodiment, a comparatively large hole 7 is provided in the bottom of the inlet 3 for facilitating the drainage of water, however such a large hole may be replaced by a number of pinholes so small in diameter as to be imperceptible. Otherwise, there may be provided a groove through which water is discharged outwardly, or the bottom wall in its entirety may be formed in a convexed funnel shape. Anyway, a requirement is that such means are effective for thoroughly draining water introduced in the inlet housing, so as to avoid electric leakage into the electric devices as well as to protect the safety device from corrosion.

It should be noted that the inlet housing 3, in this embodiment, is increased in dimension to a considerable extent, as compared with the conventional inlet structure. The reason is that the height from the floor surface 5 up to the surface of lower run of handrail 2 is greater than a thickness of the body of an infant on to the floor, so that even if an infant should be on the floor, his body cannot touch the lower run of handrail 2. The inlet housing 3 protrudes frontwardly from the front face of skirt guard 4 by a length L, which is several times (200mm in the embodiment) as long as that of the conventional one (usually 30mm), so that the height H from the floor surface 5 up to the lower run of handrail 2 may be increased. The length of the inlet structure in the conventional moving stairway, as well as the height from the floor to the lower run of handrail, were designed when such accidents to infants in the exit portions of the handrails were not contemplated. Recently, such accidents have been frequently reported, and thus it is necessary to increase the height H which is dependent on the length L of the inlet housing which encloses the front end portion of skirt guard to the front end portion of inlet structure. To this end, it is most efficacious that, without changing the handrail proper, improvements are made only in the inlet, as in the present invention, so as to positively protect an infant from being caught by the moving handrail, in the event that he is on the floor. It is anticipated that it will be infants who get caught in the opening between the floor and the lower run of handrail, in the event of the falling to the floor adjacent to the exit portion of handrail. The thickness of an infant body, when he lies on his back, is in general approximately 100 to 120mm, and hence the height H of 120mm is sufficient. Thus, considering the overall size of an moving stairway, the length L of the inlet housing 3 may be so increased that the height H becomes 120mm. In this case, the bottom of the inlet housing 3 should be maintained parallel with respect to the floor surface 5, in view of the fact that the inlet housing 3 houses therein the detecting switch 9, pairs of springs 10, 10 and 11, 11 and the lever 12. In other words, the inlet housing 3 is so arranged that the upper surface adjacent to the inclined lower run of handrail accommodates the slope of the handrail, with its bottom maintained in parallel relation to the floor 5, whereas the dimension of the inlet structure increases towards the front wall portion thereof. Thus, if the length L of the inlet housing 3 is long enough to provide the height H of at least more than 120mm (more than 100mm in the moving stairway of the general type), the safety device including the detecting switch 9 can be housed therein. It is preferable that the height H be more than 150mm, such that the safety device may be operated immediately when something is caught in the spacing Q. There exists a moving stairway having means for protecting infants from being dragged by the lower run of moving handrail, wherein the spacing between the lower run of handrail and the floor is more than 150mm. For such a moving stairway, the length of the inlet structure should be large enough (in general, 50mm) to house therein the detecting switch.

Figure 5:
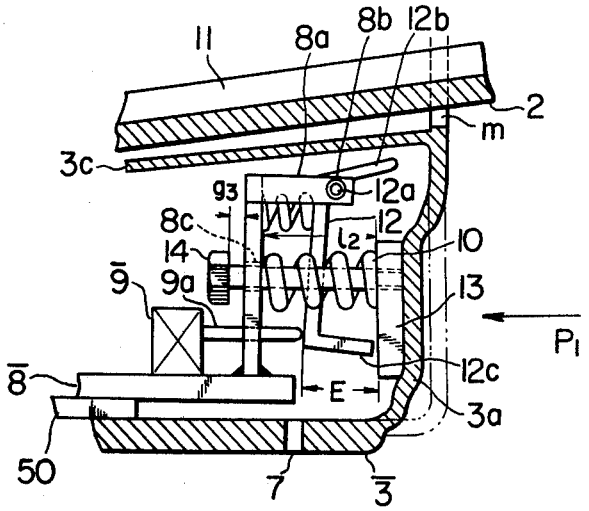
FIGS. 5 and 6 illustrate a condition where the safety device of the present invention is in operation; and, FIG. 7 shows another embodiment of the handrail safety device according to the present invention, showing in an enlarged scale portion which corresponds to that of FIG. 3.
Figure 6:
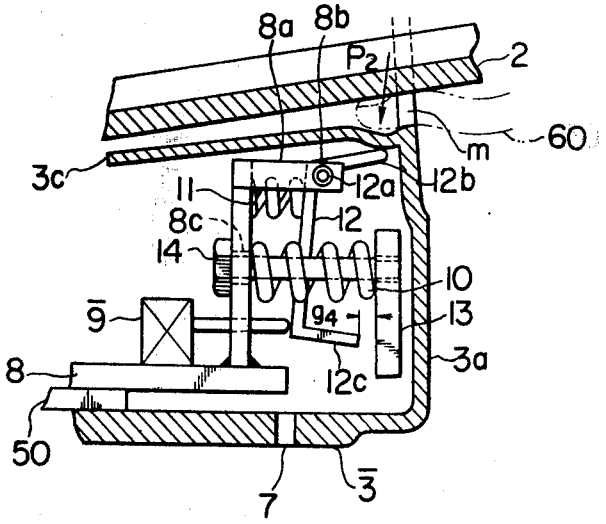

The description will be given in FIGS. 5 and 6 showing the operation of the handrail safety device when an external force acts on the inlet housing, immediately before an infant gets injured.

In the event that an infant or something is caught in the opening Q, if the external force acts on the inlet 3 in the direction of arrow $P_1$ of FIG. 5, the front end portion 3A of the inlet 3 is forced, from a normal position shown by the two-dotted line in FIG. 5 so as to press on the actuating plate 13. Due to the actuating plate 13 being pressed by the front wall portion 3A, the pair of springs 10, 10 are compressed to a length $l_2$, whereby the gap G between the actuating plate 13 and the actuating rod 9A of detecting switch 9 is narrowed to a gap E, where normally G > E. Consequently, a gap $g_3$ equivalent to a difference between the gaps G and E is created between the bolt shoulder of each bolt 14 passing through the hole 80 and the supporting member 8. Stated otherwise, the actuating plate 13 comes in contact with the front end portion 12C of 12, whereby the lever 12 is caused to slightly rotate about the supporting rod 12A serving as a fulcrum, thereby urging the actuating rod 9A, and thus the detecting switch 9 is actuated. It will be apparent that the detecting switch is put into operation when respective gaps $g_1$ and $g_2$ become nil, and when the gaps between respective members are in the relationship as follows:

$g_1 + g_2 = g_3$, and $l_1 - l_2 = l_3$

In the event that an infant has his hand 60 caught in the opening $m$ defined between the lower run of handrail and the upper side of inlet housing 3 as shown in FIG. 6, i.e., in case the external force acts on the inlet in the direction of arrow P2, a partitioning wall 3C, which extends to cover the whole width of inlet housing 3, yields downwardly to turn the opening $m$ to $M > m$. Consequently, the arm 12B of lever 12 is urged by the partitioning wall 3C, causing the lever 12 to rotate about the supporting rod 12A serving as a fulcrum, whereby the springs 11, 11 are compressed and the gap $g_2$ is turned to $g_2 < g_4$. Thus, the actuating rod 9A is urged by the lever 12 to actuate the detecting switch 9. The detecting switch 9, as set forth in the foregoing, is so arranged as to operate in response to the external force acting on the inlet housing 3 in the transverse direction P1 thereof or in the vertical direction P2, in the event that something or a human body is caught in the spacing Q or that an infant has his hand caught in the opening $m$ between the lower run of handrail and the inlet housing 3. In addition, the detecting switch 9 constitutes part of a control circuit for the moving stairway, such that due to the actuation of the detecting switch 9, the movement of the moving stairway, and hence the handrails, may be automatically interrupted. Owing to the partitioning wall 3C provided over the upper surface of inlet housing 3 for separating the safety device portion, including detecting switch 9, the lever 12 and other members from the lower run of handrail 2, and even if an infant has his hand 60 caught in the inlet 3, he cannot contact the lever 12 or other members, and hence he is free from being hurt. If his hand 60 should get into a further inner portion of the inlet housing 3 and be stuck between the rigidly mounted supporting member 8 and the lower run of handrail 2, the screw 51 can be unscrewed, with the skirt guard and the body of handrail remaining intact, whereby the safety device is demounted in its entirety, thereby releasing the infant from the stuck condition. The screw 51 serves as an auxiliary safety means.

The spring force for respective springs 10 or springs 11 is optional. Accordingly, it is possible to provide a sufficient spring force so the safety device will not operate due to a slight push applied to the inlet housing 3. In addition, pairs of springs 10, 10 and 11, 11 are so arranged as to act under a constant spring force whenever the external forces P1 and P2 are applied to the inlet respectively. As a result, the safety device is free from malfunctioning, which has been inevitable for previous devices of this type. The pair of springs 10 and 10 are given a resiliency larger than the other pair of springs 11 and 11. This is because the external force P1 is more frequently applied in comparison with the external force P2, and a rather bulky object may be caught in the opening between the lower run of handrail 2 and the floor 5, such that the actuating plate 13 may be moved by applying even a strong force thereto.

Figure 7:
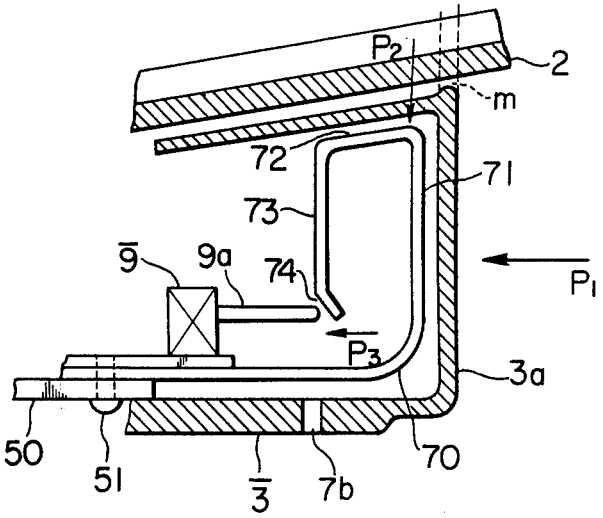

FIG. 7 illustrates another embodiment of the present invention, wherein there is provided in the inlet housing 3 a leaf spring 70, which is composed of a front portion 71, an upper portion 72, a rear portion 73 and a bent portion 74, said leaf spring being rigidly fastened by rivet 51 to the supporting member 50 rigid with the skirt guard. When the external force P1 or P2 is applied to the inlet 3, the leaf spring 70 is resiliently deformed to urge the actuating rod 9A of detecting switch by the bent portion 74, whereby the moving stairway and hence the handrails may be automatically stopped.

According to the present invention, it is essential that the inlet structure has a length in the horizontal direction, of more than 100mm, with the detecting switch being housed therein, and the external force given to the inlet either in the horizontal or vertical direction thereof may be positively transmitted to the detecting switch for the actuation thereof. Accordingly, so far as the above-described requirements are satisfied, any mechanical modification is acceptable. In addition, better results may be attained by providing drain holes and providing the partitioning front wall of the inlet housing more flexible, and forming the safety device section separately from the supporting member 50.

The safety device of the present invention is available, without giving any change to the device, for an electrically driven path having entrance and exit portions through which handrails run in or run out.

What is claimed is:

1. In a moving stairway having handrails which pass into or out of entrance and exit portions of skirt guards for the moving stairway, a handrail safety device comprising inlet structure means fixed to each skirt guard adjacent to the entrance and exit portions, said inlet structure means projecting outwardly externally from the skirt guards; and detecting means provided in said inlet structure means for detecting either one of a horizontally directed force acting on said inlet structure means or a vertically directed force acting within said entrance and exit portions to interrupt movement of the moving stairway at the occurrence of such force, wherein said inlet structure means includes a flexible housing containing said detecting means, said flexible housing having a front end portion being more flexible than the remaining housing portion.

2. A handrail safety device according to claim 1, wherein said inlet structure means projects outwardly from said skirt guard to a distance sufficient to limit the presence of objects between the lower run of the handrail and a floor surface.

3. A handrail safety device according to claim 2, wherein said inlet structure projects to at least 100 mm from the skirt guard.

4. A handrail safety device according to claim 1, wherein a height from a floor surface up to a lower run of the handrail at a front wall of said inlet structure means is at least 120 mm.

5. A handrail safety device according to claim 1, wherein said detecting means includes a switch means for providing an interrupting signal to interrupt the movement of the moving stairway and an actuating mechanism for actuating said switch means, said actuating mechanism being operable by yielding deformation of said inlet structure means in response to at least one of said horizontal and vertical forces.

6. A handrail safety device according to claim 5, wherein said actuating mechanism includes resistance means for providing resistance to inward movements of said actuating mechanism.

7. A handrail safety device according to claim 6, wherein said resistance means provides a low resistance to said horizontally directed force and provides a higher resistance to said vertically directed force.

8. A handrail safety device according to claim 5, wherein said inlet structure means includes a partitioning wall for separating the lower run of the handrail from said actuating mechanism.

9. A handrail safety device according to claim 5, wherein said detecting means is supported within said inlet structure means from a supporting member, said detecting means being demountable from said supporting member.

10. A handrail safety device according to claim 5, wherein said actuating mechanism includes a leaf spring, said leaf spring including:

a vertically extending front portion, a horizontally extending upper portion connected to an upper extremity of said front portion and directed inwardly of the inlet structure means, a vertically extending rear portion connected to an inner end of said upper portion and directed downwardly in the inlet structure, and an inclined portion bent at the lower end of said rear portion towards said front portion, said vertically extending front portion being adapted to receive said horizontally directed force applied to the inlet structure means, and said upper portion being adapted to receive said vertically directed force, whereby said inclined portion actuates said switch means.

11. A handrail safety device according to claim 1, wherein said inlet structure means includes means for draining water introduced into said inlet structure means.

12. A handrail safety device according to claim 1, wherein said detecting means is supported within said inlet structure means from a supporting member, said detecting means being demountable from said supporting member.

13. In a moving stairway having inlet structures provided externally of skirt guards adjacent to entrance and exit portions through which handrails run into or out of, a handrail safety device comprising:

each of said inlet structures being projected externally of each skirt guard adjacent to the entrance and exit portions to a distance at least 100 mm from the skirt guard, and a detecting switch provided in the inlet structure, said detecting switch being actuated in response to an external force applied to the inlet structure either in a horizontal direction thereof or in a vertical direction, thereby interrupting movement of the moving stairway, wherein there is provided in the inlet structure a mechanism for actuating said detecting switch, wherein said actuating mechanism is composed of a first actuating member adapted to shift inwardly of the inlet structure under the external force applied to the inlet structure in the horizontal direction thereof, and a second actuating member adapted to shift inwardly of the inlet structure under the external force given to the inlet structure in a vertical direction thereof.

14. In a moving stairway having handrails which pass into or out of entrance and exit portions of skirt guards for the moving stairway, a handrail safety device comprising:

inlet structure means fixed to each skirt guard adjacent to the entrance and exit portions, said inlet structure means projecting outwardly externally from the skirt guards; and detecting means provided in said inlet structure means for detecting at least one of a horizontally directed force or a vertically directed force acting on said inlet structure means to interrupt movement of the moving stairway at the occurrence of such force, wherein said detecting means includes a switch means for providing an interrupting signal to interrupt the movement of the moving stairway and an actuating mechanism for actuating said switch means, said actuating mechanism being operable by yielding deformation of said inlet structure means in response to at least one of said horizontal and vertical forces, and wherein said actuating mechanism includes a first actuating member adapted to shift inwardly of the inlet structure means under said horizontally directed force, and a second actuating member adapted to shift inwardly of the inlet structure means under said vertically directed force.

* * * * *